United States Patent [19]

Jones

[11] Patent Number: 4,718,312

[45] Date of Patent: Jan. 12, 1988

[54] MOTORIZED TWIST OFF CAP OPENER

[76] Inventor: William C. Jones, Bourbon Rd., R.R. 2, Box 152, Tuscola, Ill. 61953

[21] Appl. No.: 819,818

[22] Filed: Jan. 16, 1986

[51] Int. Cl.[4] ..... B67B 7/18

[52] U.S. Cl. ..... 81/3.2

[58] Field of Search ..... 81/3.2, 3.33, 3.4; 53/381 A

[56] References Cited

U.S. PATENT DOCUMENTS

| | | | |
|---|---|---|---|
| 1,022,591 | 4/1912 | Perry . | |
| 1,702,261 | 2/1929 | Johnson | 81/3.2 |
| 1,837,257 | 12/1931 | Eames . | |
| 1,856,827 | 5/1932 | Carruthers . | |
| 2,005,186 | 6/1935 | Griswold . | |
| 2,656,084 | 10/1953 | Filander | 81/3.2 |
| 2,761,337 | 9/1956 | Daniel | 81/3.4 |
| 3,604,290 | 9/1971 | Walte | 81/3.4 |
| 3,795,158 | 5/1974 | Morita | 81/3.2 |
| 3,919,901 | 12/1974 | Braman | 81/3.4 |
| 3,950,801 | 4/1976 | Morrison | 81/3.33 |
| 4,102,226 | 7/1978 | McGuire | 81/3.33 |
| 4,337,678 | 7/1982 | Mumford | 81/3.4 |
| 4,358,970 | 11/1982 | Jacobson | 81/3.2 |
| 4,433,597 | 2/1984 | Rowland | 81/3.1 |
| 4,455,894 | 6/1984 | Roberts | 81/3.1 |
| 4,474,087 | 10/1984 | Widman | 81/3.1 |
| 4,519,276 | 5/1985 | Grabarski | 81/3.2 |

*Primary Examiner*—Roscoe V. Parker

*Attorney, Agent, or Firm*—Grace J. Fishel

[57] ABSTRACT

A machine for opening twist off caps on bottles, jars or the like which is engaged by pressing the cap into the opening device and which leaves the user with both hands free to hold the vessel being opened.

14 Claims, 6 Drawing Figures

MOTORIZED TWIST OFF CAP OPENER

The present invention relates to a machine for opening twist off caps on bottles, jars or the like.

Twist off caps may be threaded or may have an internal liner which is deformed to engage external threads on the neck of a container.

All devices for opening twist off caps increase the amount of torque applied to opening a lid. Most of these devices include a jaw for gripping the twist off cap connected to a handle for applying increased torque but the exact form of the jaw and of the handle differ widely. One difficulty with devices of this type is that the user must hold the vessel being opened with one hand while trying to manipulate the opener with the other. Included in this process is the problem of locking the jaw on the cap with one hand and the problem of gripping the vessel with sufficient force so that it does not turn with the cap. People with small hands or with physical disabilities such as arthritis find it particularly difficult to accomplish the above-mentioned operations.

There have been jar opening devices such as that described in U.S. Pat. No. 4,102,226 which address the problem of how to hold the container while operating the opener by providing clamps for clamping the vessel. These devices are operable but not practical in that it is too cumbersome to clamp the vessel before the opening operation can be initiated.

In view of the above, there is a need for a twist off cap opener which allows the user to devote both hands to holding the vessel being opened such that the user can resist the force applied to the cap with both hands. There is also a need for a twist off cap opener which can be engaged by simply pressing the cap into the opening device. It is therefore an object of the present invention to provide a motorized twist off cap opener which has the above-mentioned features. Other objects and features will be in part apparent and in part pointed out hereinafter.

The invention accordingly comprises the constructions hereinafter described, the scope of the invention being indicated in the subjoined claims.

In the drawings in which one of several possible embodiments of the invention is illustrated, corresponding reference numerals refer to corresponding parts and in which.

Figure 1:
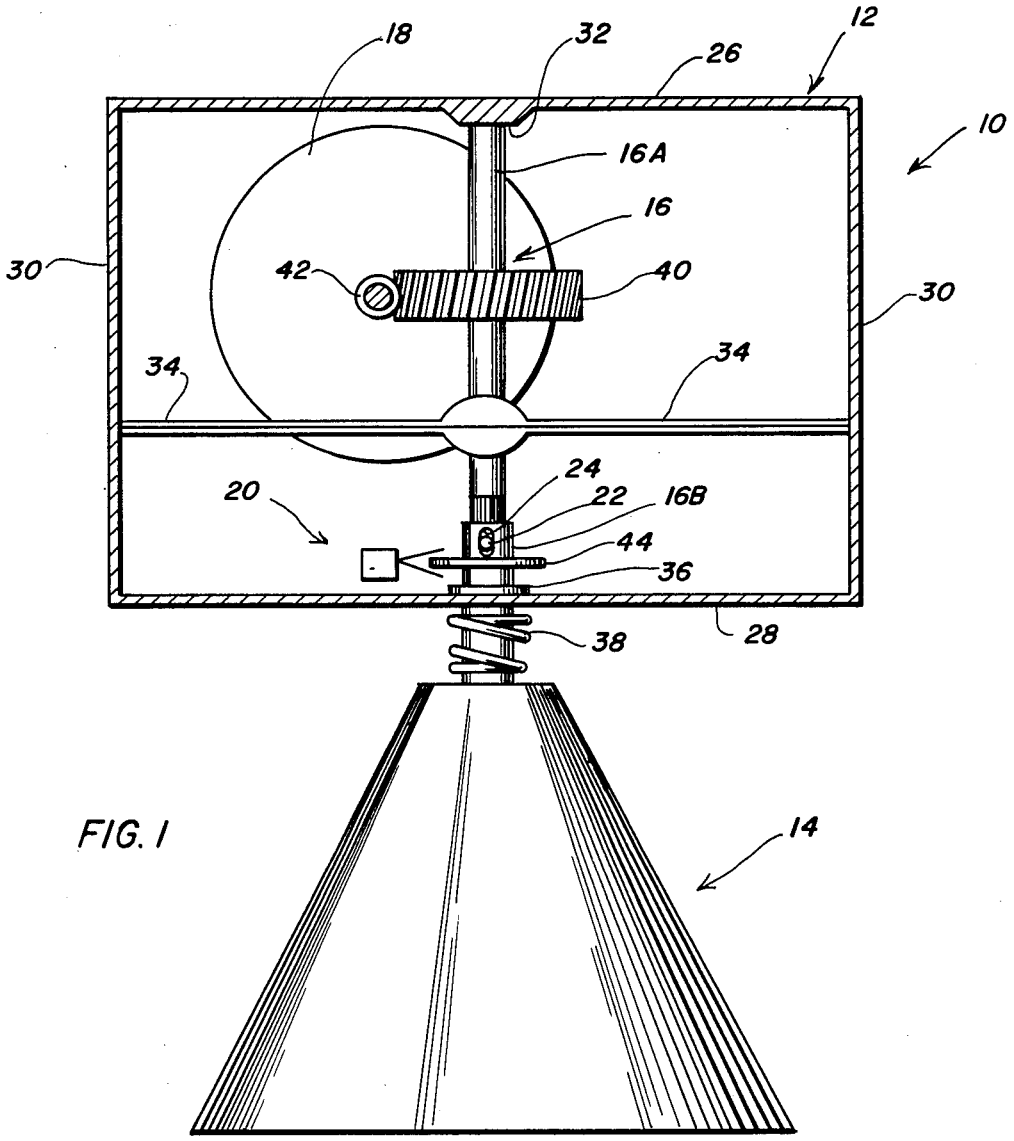
FIG. 1 is a front view, partly in section, of a motorized twist off cap opener having a cone operator and in accordance with the present invention.
Figure 2:
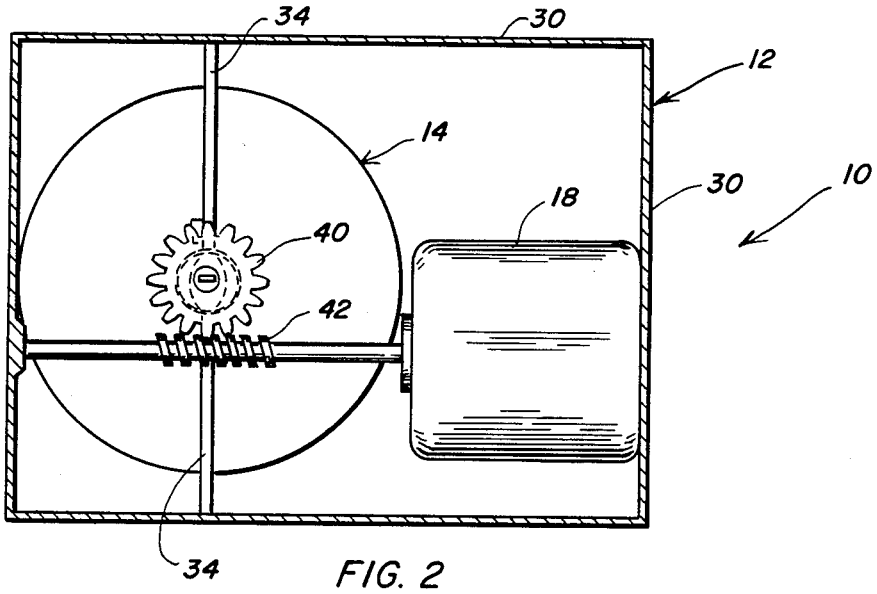
FIG. 2 is a top view of the opener as shown in FIG. 1.

Referring to the drawings more particularly by reference number, reference numeral 10 refers to a motorized twist off cap opener in accordance with the present invention including a housing 12 for supporting a cone operator 14 suspended on a shaft 16 and driven by a motor 18 which is actuated by a switch 20 that is responsive or triggered by linear movements of the cone parallel to the shaft.

Figure 3:
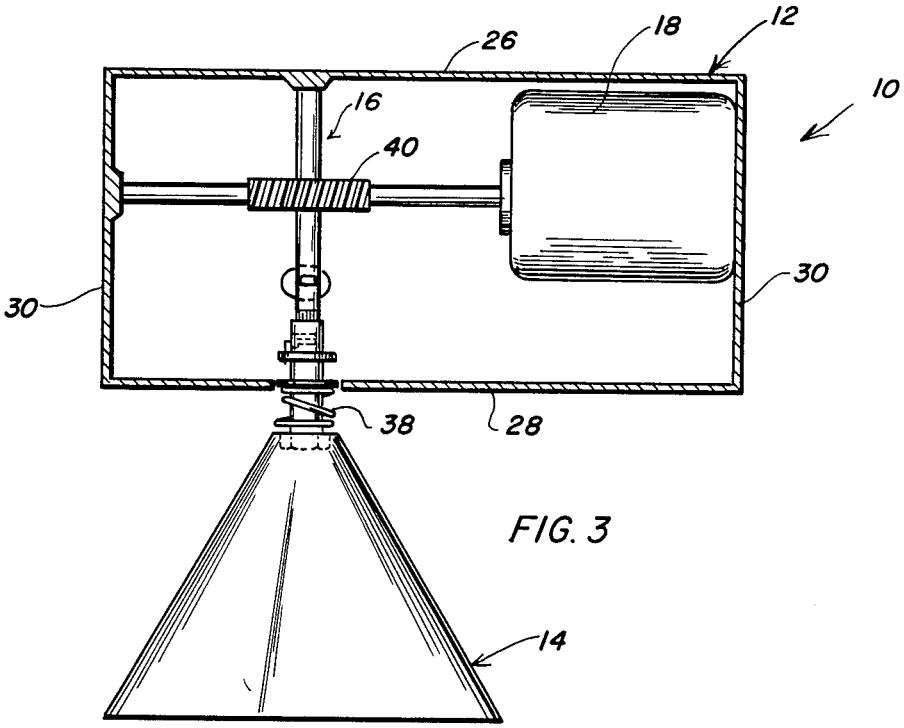
FIG. 3 is a left side view of the opener as shown in FIG. 2.

More particularly, as best seen in FIGS. 1 and 3, shaft 16 is made up of first and second telescoping sections **16*a* and 16*b*. Section 16*a* is attached to section 16*b* by pin 22 which extends through a closed keyway 24 provided in that end of shaft 16*b* distal cone operator 14. With reference to the drawings, it will be understood that pin 22 limits movements of section 16*b* with respect to section 16*a*** between a first and second or upper and lower limit.

With continuing reference to FIGS. 1 and 3, housing 12 is shown as a generally rectangular enclosure with an upper and lower wall 26 and 28, respectively, encircled by sidewalls 30. Shaft **16*a* depends from upper wall 26 and is journaled in bearing 32. Mounted on shaft 16*a* is a toothed gear 40 in mesh with a speed reducing gear 42 which is driven by motor 18. Motor 18 rotates shaft 16*a* in a counterclockwise motion viewing the lid from above but can be reversible, in which case, opener 10 can serve both to remove and to tighten a lid. A pair of lateral side supports 34 provide a bearing and bridge shaft 16 between opposing sidewalls 30 and are provided generally midway the distance between upper and lower walls 26 and 28. That end of shaft 16*b* distal its attachment to shaft 16*a* extends through an aperture or collar 36 provided in lower wall 28 for attachment to the truncated end of cone operator 14. A spring biasing means shown as coil spring 38, is threaded on shaft 16*b* between lower wall 28 and cone operator 14 biasing shaft 16 to its longest length and pin 22 against the lower limit of keyway 24**.

Switch 20 is mounted on shaft **16*b* such that movements of cone operator 14 compressing spring biasing means 38 actuate motor 18. By way of example in the embodiment illustrated, this may be accomplished by means of a switch contact ring 44 mounted on shaft 16*b* such that the contact ring actuates or toggles switch 20 on as spring biasing means 38 is compressed and pin 22 is brought against the upper limit of keyway 24** and then toggles the switch off as pressure on the spring biasing means is released.

Figure 5:
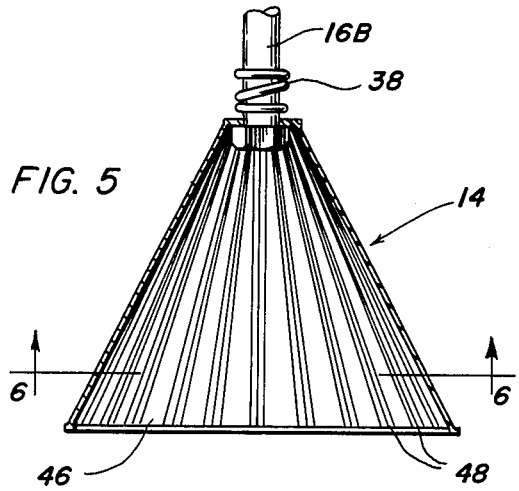
FIG. 5 is taken along line 5—5 in FIG. 4.
Figure 4:
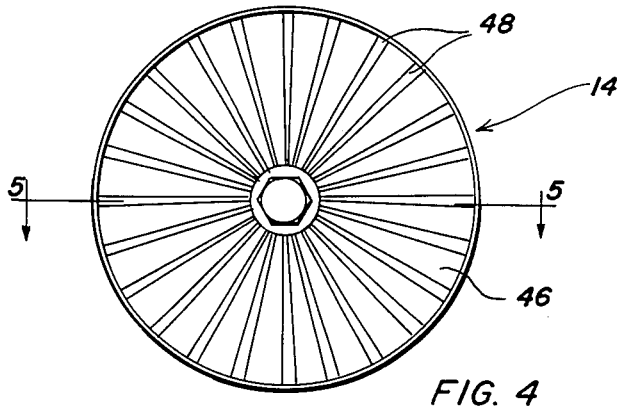
FIG. 4 is a bottom view of the cone operator.
Figure 6:
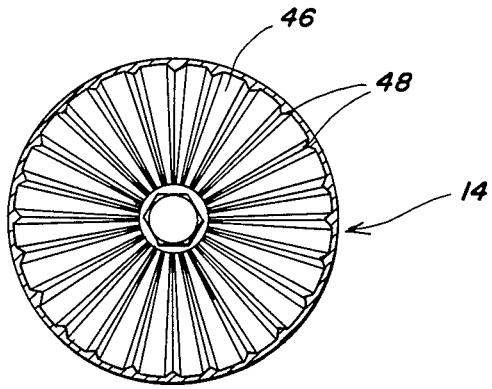
FIG. 6 is taken along line 6—6 in FIG. 5.

Details of cone operator 14 are shown in FIGS. 4–6. Referring now to those drawings, cone operator 14 comprises a generally conically shaped body which is truncated at its apex for attachment to the lower end of shaft **16*b* as described above. The interior of cone operator 14 is made of some rigid material such as stainless steel or the like and has a hollow frustoconical recess 46 which is lined with a friction surface or which is ribbed with a series of converging ridges 48 for providing better frictional engagement with a twist off cap. Ribs 48 are illustrated as sharpened ridges which widen as they approach the flared end of the cone operator. Cone operator 14 is dimensioned such that recess 46 will engage a large sized twist off cap at its flared end whereas smaller lids of gradually lesser diameter are engaged if inserted more deeply into the recess. Cone operator 14 may be made easily detachable from shaft 16*b***, as for example by a set screw (not shown) or the like, such that it can be readily removed for cleaning or for use of the cone operator as a hand operated opening device.

At the beginning of a duty cycle, shaft 16 is extended to its maximum extent and switch contact ring 44 has toggled motor 18 off. A user with a twist off cap in need of being opened, merely inserts the lid to be removed into the open end of cone operator 14. He then pushes the lid into engagement with ribs 48 with sufficient force to compress spring biasing means 38. As spring biasing means 38 is compressed, shaft **16*b* displaces switch contact ring 44 which toggles motor 18 on. As long as this pressure is maintained, motor 18 operates to rotate shaft 16** thus twisting off the cap.

In the embodiment illustrated, twist off cap opener 10 is designed for advantageous attachment as a space saving under-the-counter cabinet appliance to eliminate kitchen counter clutter. It is to be understood, however, that the opener may be wall mounted, mounted on a stand or hand held and modified accordingly as necessary for the particular mounting arrangement as will readily occur to one skilled in the art.

In view of the above, it will be seen that the several objects of the invention are achieved and other advantageous results attained. For example, it is seen that the present machine provides a means for opening a twist off cap wherein the user has both hands free to hold the container being opened and wherein the opener can be engaged by simply inserting the lid into the device. As various changes could be made in the above described construction without departing from the scope of the invention, it is intended that all matter contained in the above description shall be interpreted as illustrative and not in a limiting sense.

What is claimed is:

1. A motorized kitchen-appliance type opener for removing twist off caps having a range of diameters found in a kitchen from containers without need for manual twisting of same and allowing the user to have both hands free to hold the container duriing the cap removal operation, said opener comprising:

(a) a housing;

(b) a unitary operator supported from said housing, said operator having a generally conically shaped body with a recessed opening having rigid interior exposed surfaces, the recessed opening being flared for receiving and frictionally engaging larger sized twist off caps towards outer portions thereof and smaller sized twist off caps of lesser diameter more deeply therein whereby said opener accommodates a range of cap sizes found in a kitchen without need for changing said operator;

(c) a motor supported by said housing and operatively connected to said operator to cause rotative movement thereof when said motor is actuated; and (d) switch means for turning said motor on or off responsive to the user's insertion of the twist off cap into said recessed opening and pressing the cap against the surface thereof, or releasing the same therefrom.

2. The opener of claim 1 wherein the operator has a generally conically shaped recess and is mounted on a shaft driven by the motor.

3. The opener of claim 2 wherein the operator is mounted to the shaft at its truncated end and wherein the switch is mounted on the shaft and is responsive to movements of the operator parallel to the shaft.

4. The opener of claim 3 wherein the shaft has first and second sections in telescoping relationship for movement between first and second limits.

5. The opener of claim 4 wherein the first telescoping section of the shaft is driven by the motor and wherein the switch comprises a contact mounted on the second telescoping section, said contact turning the motor on when the telescoping sections are against the first limit and turning the motor off when the telescoping sections are against the second limit.

6. The opener of claim 1 wherein the opener has a housing with first and second opposing walls encircled by sidewalls, said first telescoping section being journaled in a bearing mounted on the first wall and said second telescoping section passing through a collar in the second wall.

7. The opener of claim 6 wherein a spring biasing means is provided on the second telescoping section between the second wall and the operator which biases the telescoping sections against the second limit.

8. A motorized kitchen-appliance type opener for removing twist off caps having a range of diameters normally found in a kitchen from containers without need for manual twisting of same and allowing the user to have both hands free to hold the container during the cap removal operation, said opener comprising:

(a) a housing;

(b) an exposed unitary operator which is readily accessible for cleaning depending from said housing, said operator having a generally conically shaped body with a recessed opening having interior exposed surfaces, the recessed opening being flared for receiving and frictionally engaging larger sized twist off caps towards outer portions thereof and smaller sized twist off caps of lesser diameter more deeply therein, whereby said opener accommodates a range of cap sizes normally found in a kitchen without need for changing said operator;

(c) a motor supported by said housing and operatively connected to said operator to cause rotative movement thereof when said motor is actuated;

(d) switch means for turning said motor on or off responsive to the user's insertion of the twist off cap into said recessed opening and pressing the cap against the surface thereof, or releasing the same therefrom; and, (e) means disposed outside said housing for detachably securing the operator to said motor.

9. The opener of claim 8 wherein the operator is mounted on a shaft driven by the motor.

10. The opener of claim 9 wherein the switch is mounted on the shaft and is responsive to movements of the operator parallel to the shaft.

11. The opener of claim 10 wherein the shaft has first and second sections in telescoping relationship for movement between first and second limits.

12. The opener of claim 11 wherein the first telescoping section of the shaft is driven by the motor and wherein the switch comprises a contact mounted on the second telescoping section, said contact turning the motor when the telescoping sections are against the first limit and turning the motor off when the telescoping sections are against the second limit.

13. The opener of claim 12 wherein the opener has a housing with first and second opposing walls encircled by sidewalls, said first telescoping section being journaled in a bearing mounted on the first wall and said second telescoping section passing through a collar in the second wall.

14. The opener of claim 13 wherein a spring biasing means is provided on the second telescoping section between the second wall and the operator which biases the telescoping sections against the second limit.

* * * * *